US006766926B1

(12) United States Patent
Elchert

(10) Patent No.: US 6,766,926 B1
(45) Date of Patent: Jul. 27, 2004

(54) DISPENSING CLOSURE, PACKAGE AND METHOD OF MANUFACTURE

(75) Inventor: Rodney A. Elchert, Bowling Green, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 168 days.

(21) Appl. No.: 10/208,443

(22) Filed: Jul. 29, 2002

(51) Int. Cl.[7] ..... B65D 5/72
(52) U.S. Cl. ..... 222/498; 222/546; 222/556
(58) Field of Search ..... 222/498, 541.1, 222/546, 556

(56) References Cited

U.S. PATENT DOCUMENTS

| | | | | |
|---|---|---|---|---|
| 4,358,032 | A | 11/1982 | Libit | |
| 4,625,898 | A | 12/1986 | Hazard | |
| 4,666,068 | A | * 5/1987 | Bush | 222/546 |
| 4,735,334 | A | 4/1988 | Abbott | |
| 4,793,501 | A | 12/1988 | Beck | |
| 4,801,054 | A | 1/1989 | Nycz | |
| 4,895,282 | A | 1/1990 | Robinson | |
| 4,993,606 | A | 2/1991 | Bolen | |
| D334,538 | S | 4/1993 | Bolen | |
| 5,251,793 | A | * 10/1993 | Bolen et al. | 222/546 |
| 5,358,130 | A | 10/1994 | Mengeu. | |
| 5,395,015 | A | 3/1995 | Bolen | |
| 5,547,091 | A | 8/1996 | Neveras | |
| 5,685,444 | A | 11/1997 | Valley | |
| 5,913,435 | A | 6/1999 | Fuchs | |
| 6,039,224 | A | 3/2000 | Dallas | |
| 6,041,477 | A | 3/2000 | Rentsch | |
| 6,311,878 | B1 | 11/2001 | Kimble | |
| 6,321,923 | B1 | 11/2001 | Wood | |

FOREIGN PATENT DOCUMENTS

| | | |
|---|---|---|
| WO | 8200278 | 2/1982 |

* cited by examiner

*Primary Examiner*—Philippe Derakshani

(57) ABSTRACT

A dispensing closure includes a base and a lid integrally connected to the base by at least one hinge element for pivoting the lid between a closed position overlying the base and an open position remote from the base. The base includes a deck wall, a skirt coupled to the deck wall and having an internal thread or bead for securing the closure to a container, and a dispensing opening in the deck wall. The lid includes a skirt that surrounds the deck wall in the closed position of the lid. The lid skirt has an interruption at the hinge element into which the hinge element is received in the closed position of the lid. The deck wall has an upstanding part-annular arcuate wall positioned around a peripheral portion of the deck wall adjacent to the hinge element and internally adjacent to an internal surface of the lid skirt at the hinge element to retard entry of moisture through the lid skirt interruption in the closed position of the lid. The lid skirt is free of engagement with the upstanding wall between the open and the closed positions of the lid, which is to say that the upstanding wall serves only to retard entry of moisture through the hinge interruption in the lid skirt and does not affect the function of opening and closing the lid.

20 Claims, 4 Drawing Sheets

DISPENSING CLOSURE, PACKAGE AND METHOD OF MANUFACTURE

The present invention is directed to dispensing closures for fluid products such as beverages, food condiments and body lotions, to fluid dispensing packages that include such a closure, and to methods of making such a closure.

BACKGROUND AND SUMMARY OF THE INVENTION

Fluid dispensing closures typically are comprised of a one-piece integrally molded structure that includes a base and a lid integrally connected to the base by one or more hinge elements. The base includes a dispensing opening through which product may be dispensed in the open position of the lid, and through which dispensing is blocked in the closed position of the lid. U.S. Pat. Nos. 4,638,916, 5,489,035, and 5,913,435 illustrate dispensing closures of this type. A problem with dispensing closures of this type is that moisture can enter the area between the lid and the base in the closed position of the lid, forming unsightly moisture droplets or spots when the lid is opened by a user. It is a general object of the present invention to provide a dispensing closure, a dispensing closure and container package, and a method of making a dispensing closure in which provision is made for sealing the area between the closure base and the closure lid in the closed position of the lid to retard entry of moisture into this area.

A dispensing closure in accordance with a first aspect of the present invention includes a base, a lid and a pair of spaced hinge elements integrally connecting arcuate peripheral portions of the base and lid for pivoting the lid between a closed position overlying the base and an open position remote from the base. The base includes a deck wall, a skirt coupled to the deck wall and having at least one internal thread or bead for securing the closure to a container, and a dispensing opening in the deck wall. The lid includes a skirt that surrounds the deck wall in the closed position of the lid. The lid skirt has interruptions at the hinge elements, into which each hinge element is received in the closed position of the lid. The deck wall has an upstanding part-annular wall positioned around the arcuate peripheral portion of the deck wall adjacent to the hinge elements, and internally adjacent to an internal surface of the lid skirt at the hinge elements to retard entry of moisture through the lid skirt interruptions in the closed position of the lid. The lid skirt is free of engagement with the upstanding wall between the open and the closed positions of the lid, which is to say that the upstanding wall serves only to retard entry of moisture through the hinge interruptions in the lid skirt and does not affect the function of opening and closing the lid.

A dispensing closure in accordance with another aspect of the present invention, which maybe implemented separately from or more preferably in combination with other aspects of the invention, includes a base and a lid integrally connected to the base by at least one hinge element for pivoting the lid between a closed position overlying the base and an open position remote from the base. The base includes a deck wall, a skirt coupled to the deck wall and having one or more internal threads or beads for securing the closure to a container, and a dispensing opening in the deck wall. The lid includes a skirt that surrounds the deck wall in the closed position of the lid. There is an interruption in the lid skirt at the hinge element or elements, into which each hinge element is received in the closed position of the lid. The deck wall has a radially outwardly projecting bead extending around a peripheral portion of the deck wall for abutting internal engagement with an internal surface of the lid skirt to retard entry of moisture between the deck wall and the lid skirt in the closed position of the lid. An upstanding part-annular wall is positioned around a peripheral portion of the deck wall adjacent to the hinge element(s), and internally adjacent to an internal surface of the lid skirt at the hinge element(s), to retard entry of moisture through the interruption(s) in the lid skirt in the closed position of the lid.

Other aspects of the present invention contemplate a closure and container package that includes a container and a dispensing closure in accordance with the first or second aspect of the invention discussed above, and a method of making a dispensing closure by integrally injection molding the closure in accordance with the first or second aspect of the invention described above.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
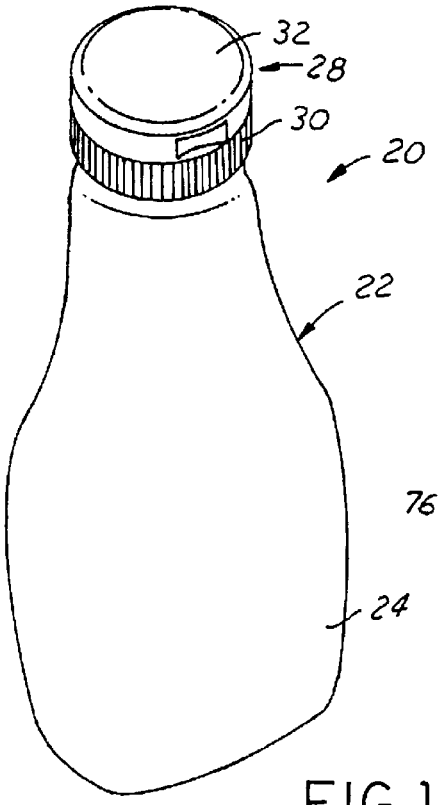
FIG. 1 is a perspective view of a closure and container package in accordance with one exemplary embodiment of the present invention.
Figure 3:
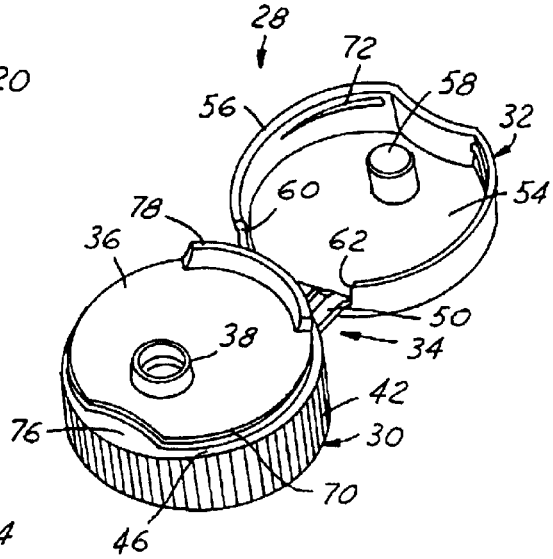
FIG. 3 is a front perspective view of the dispensing closure in FIGS. 1 and 2 in the open position.
Figure 2:
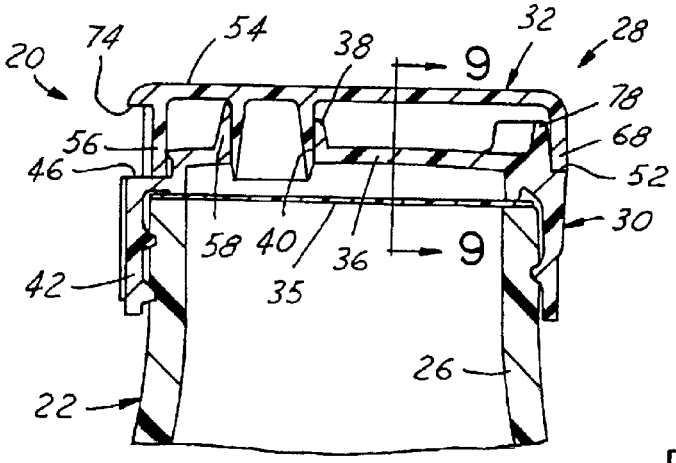
FIG. 2 is a fragmentary sectional view of the package illustrated in FIG. 1.

FIGS. 1 and 2 illustrate a fluid dispensing closure and container package 20 as including a container 22 having a body 24 and a cylindrical finish 26. A dispensing closure 28 includes a base 30 secured to finish 26 of container 22, and a lid 32 integrally connected to base 30 by at pivot hinge 34. A disk liner 35 is disposed beneath closure 28 in assembly to container finish 26. Liner 35 preferably is induction welded or otherwise suitably secured to finish 26, and must be removed by a user prior to dispensing product.

Referring to FIGS. 1–5 and 9–10, base 30 of closure 28 includes a deck wall 36, which is slightly upwardly convex in the illustrated exemplary embodiment of the invention.

Deck wall 36 may be flat, dished or domed, and may be perpendicular to or at an angle to the axis of the closure. An annular wall 38 is upstanding from deck wall 36 and surrounds a dispensing opening 40 in the deck wall. Deck wall 36 is coupled to a peripheral skirt 42. Deck wall 36 is circular and skirt 42 is cylindrical in the exemplary embodiment of the invention. Skirt 42 has one or more internal threads or beads 44 for securing dispensing closure 28 to corresponding external threads or beads on container finish 26 (FIG. 2). The peripheral edge of deck wall 36 is recessed radially inwardly from the outer surface of skirt 42 so as to form an axially upwardly facing recessed ledge 46 around deck wall 36. (Directional words such as "upwardly" and "downwardly" are employed by way of description and not limitation with respect to the upright orientation of the closure and package illustrated in FIGS. 1-3 and 5. Directional words such as "axially" and "radially" are employed by way of description and not limitation with respect to the central axis of container finish 26 or closure skirt 42 as applicable.)

Figure 4:
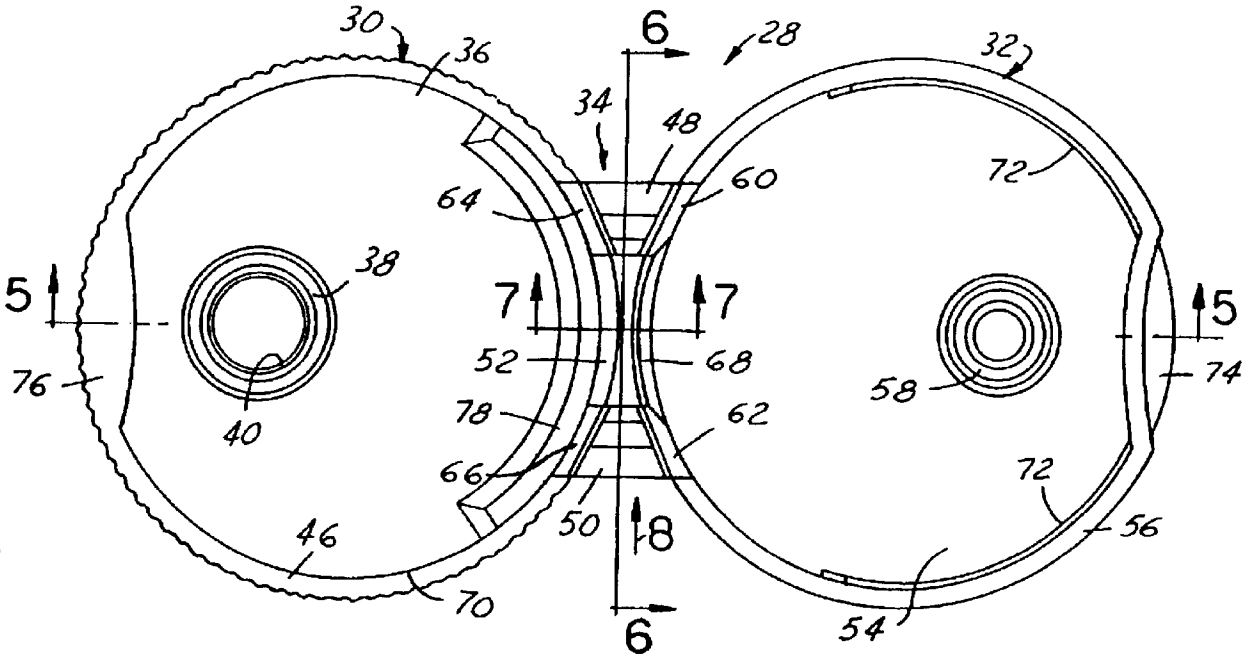
FIG. 4 is a top plan view of the dispensing closure illustrated in FIG. 3.

Hinge 34 preferably comprises a pair of laterally spaced hinge elements 48, 50 (FIGS. 3–8 and 10). These hinge elements 48, 50 preferably are of the construction illustrated in U.S. Pat. No. 6,041,477, the disclosure of which is incorporated herein by reference. Ledge 46 extends around the periphery of deck wall 36, except between hinges 48, 50 in the illustrated embodiment of the invention. A supplemental arcuate ledge 52 is disposed between hinge elements 48, 50, and is raised slightly with respect to the level of ledge 46, for reasons to be described. Ledges 46, 52 lie in respective planes that are perpendicular to the axis of skirt 42. Hinge elements 48, 50 extend between adjacent opposed arcuate peripheral portions of base 30 and lid 32, as best seen in FIG. 4.

Figure 5:
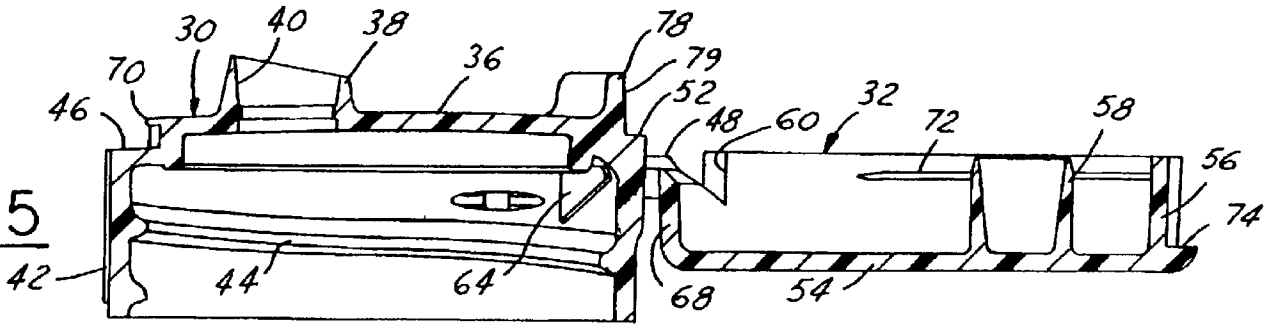
FIGS. 5–7 are sectional views taken substantially along the respective lines 5—5, 6—6 and 7—7 in FIG. 4.
Figure 6:
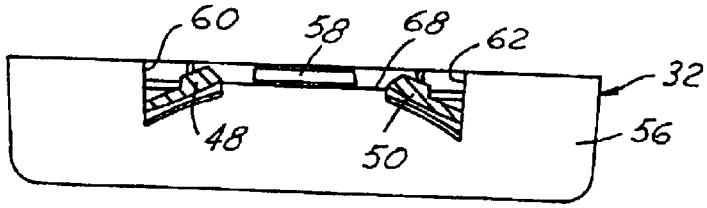
Figure 7:
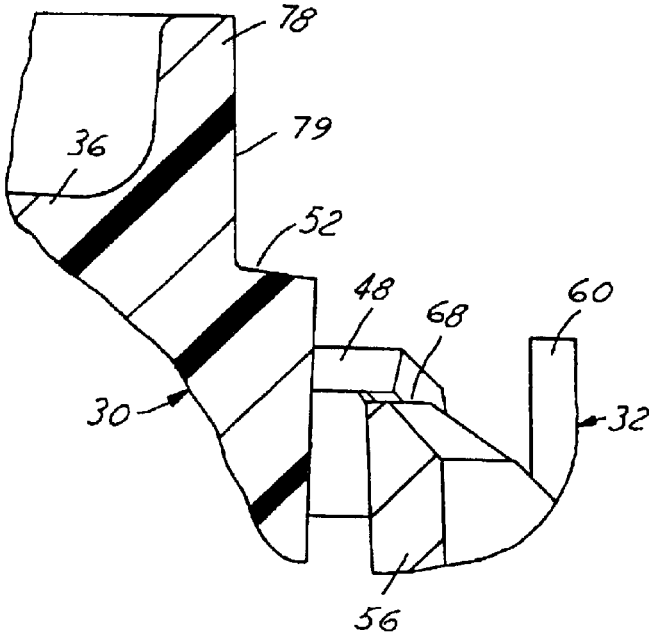
Figure 8:
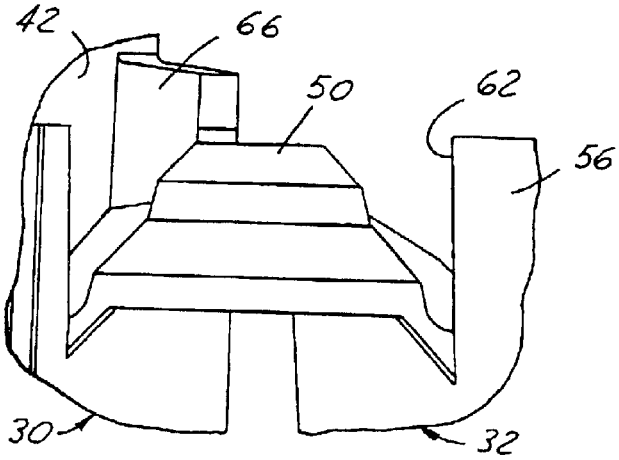
FIG. 8 is a fragmentary elevational view taken from the direction 8 in FIG. 4.
Figure 9:
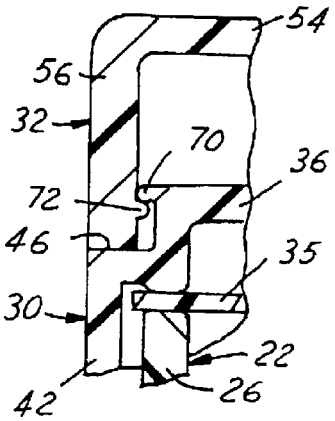
FIG. 9 is a fragmentary sectional view taken substantially along the line 9—9 in FIG. 2.

Lid 32 includes a base wall 54 and a peripheral skirt 56. Lid base wall 54 may be flat, dished or domed, and at any suitable angle. An annular wall or spud 58 projects from the inside surface of lid base wall 54 for internal plug-sealing engagement within dispensing opening 40 surrounded by wall 38 on deck wall 36. Hinge elements 48, 50 are coupled to skirt 56 of lid 32. It is a characteristic of hinges of the subject type that there are openings or interruptions 60, 62 in lid skirt 56 into which the hinges are disposed in the closed position of the lid. A pair of pockets 64, 66 (FIGS. 4–8) are likewise provided in base skirt 42 for receiving hinge elements 48, 50 in the closed position of the lid. In this way, the hinge elements are flush with the outer surfaces of the lid and base skirts, and do not project radially outwardly from the skirts as is typical in the prior art. The lid skirt also includes a portion 68 between interruptions 60, 62 which is recessed with respect to the axial edge of skirt 56, as best seen in FIG. 5, for receipt over ledge portion 52 on base 30. The axial edge of lid skirt 56 preferably lies in a plane, and preferably abuts the planar surface of ledge 46 in the closed position of the lid (FIGS. 2 and 9) so that lid skirt 56 is axially aligned with base skirt 42. Lid skirt portion 68 is closely adjacent to or abuts base ledge portion 52 in the closed position of the lid (FIG. 2).

A radially outwardly projecting bead 70 extends circumferentially around the periphery of deck wall 36 in a plane parallel to but axially spaced from ledge 46. This bead 70 engages the radially inner surface of lid skirt 56 when the lid is in the closed position (FIGS. 2 and 9) to seal against entry of moisture into the area between the lid and the deck wall in the closed position of the lid. An internal bead 72 (FIGS. 4–5 and 9–10) extends circumferentially part-way around the internal surface of lid skirt 56. Bead 72 lies in a plane parallel to but spaced from the edge of skirt 56, and is positioned on lid 32 for snap-receipt over bead 70 on closure base 30 to hold the lid in the closed position with the axial edge of lid skirt 56 in abutment with ledge 46 on base 30. Lid 32 is provided with a thumb recess 74, which is aligned with a corresponding thumb recess 76 on base 30 in the closed position of the lid, for manually unsnapping bead 72 from bead 70 and moving the lid to the open position illustrated in FIGS. 3–5 and 10. Other thumb recess/projection configurations may be employed.

Figure 10:
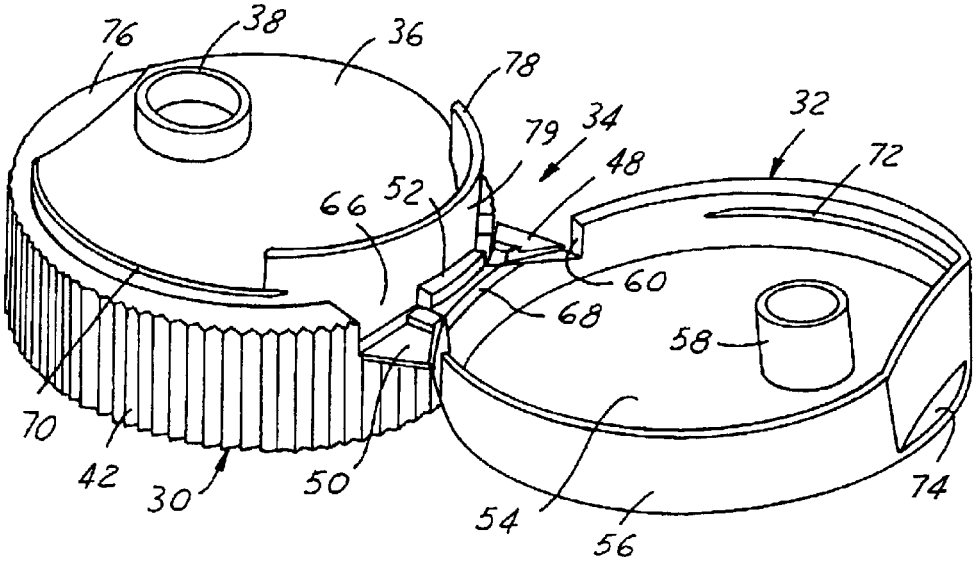
FIG. 10 is a rear perspective view of the exemplary closure in the open position.

An arcuate part-annular wall 78 is upstanding from the periphery of deck wall 36 adjacent to hinge elements 48, 50. Upstanding wall 78 is radially inwardly adjacent to ledge portion 52 of base 30, and has an arcuate dimension which is greater than the angular distance between the outer edges of hinge elements 48, 50 and the corresponding outer edges of pockets 64, 66 (FIG. 4). In an exemplary embodiment of the invention, wall 78 has an arcuate dimension of 110°, being symmetrical around the mid point between the hinge elements. By way of comparison, the corresponding arcuate dimension between the outer edges of pockets 64, 66 is about 66°. The radially outer surface 79 of wall 78 is substantially cylindrical at minimum draft angle (e.g., 2°). As best seen in FIGS. 2, 5 and 10, rib 70 does not extend around the outer surface of wall 78. The radially outer surface of wall 78 is disposed on base 30 for radial facing abutment with the portions of lid skirt 56 and lid skirt section 68 (FIG. 2) around interruptions 60, 62 in the lid skirt for the hinges. The radially outer surface of upstanding wall 78 is in facing abutment with the radially inner surface of lid skirt 56, and thus cooperates with the radially inner surfaces of lid skirt 56 and lid skirt portion 68 to function as a seal and retard entry of moisture into the closure in the closed position of the lid.

There have thus been disclosed a dispensing closure, a dispensing closure and container package and a method of manufacture that fully achieve all of the objects and aims previously set forth. The invention has been disclosed in conjunction with a presently preferred embodiment thereof, and a number of modifications and variations have been discussed. Other modifications and variations will readily suggest themselves to persons of ordinary skill in the art. For example, the closure base and lid are of circular geometry in the disclosed embodiments of the invention. However, the closure base could be a double skirt-type base, having a cylindrical inner skirt for securement to a container finish and an outer skirt (and deck wall and lid) of any desired geometry (e.g., oval) to blend with the contours of the container sidewall. The invention is intended to embrace all such modifications and variations as fall within the spirit and broad scope of the appended claims.

What is claimed is:

1. A dispensing closure that includes:

a base, and a lid integrally connected to said base by at least one hinge element for pivoting said lid between a closed position overlying said base and an open position remote from said base, said base including a deck wall, a skirt coupled to said deck wall and having internal means for securing the closure to a container, and a dispensing opening in said deck wall, said lid including a skirt that surrounds said deck wall in said closed position of said lid, said lid skirt including an interruption of said hinge clement into which said hinge is received in said closed position of said lid, said deck wall having a radially outwardly projecting bead extending around a peripheral portion of said deck wall for abutting internal engagement with an internal surface of said lid skirt to retard entry of moisture in said closed position of said lid, and an upstanding arcuate wall positioned around a peripheral portion of said deck wall adjacent to said hinge element and internally adjacent to an internal surface of said lid skirt at said hinge element to retard entry of moisture through said interruption in said closed position of said lid.

2. The closure set forth in claim 1 wherein said skirt on said lid has an internal bead that extends at least part-way around said skirt for snap-receipt over said bead on said deck wall in said closed position of said lid.

3. The closure set forth in claim 2 wherein said deck wall is recessed radially inwardly from said skirt on said base and said skirt on said lid aligns with said skirt on said base in said closed position of said lid.

4. The closure set forth in claim 1 wherein said arcuate wall portion on said deck wall has an arcuate dimension that is at least as great as the arcuate dimension of said interruption in said skirt lid.

5. The closure set forth in claim 1 wherein said bead on said deck wall does not extend beneath said upstanding arcuate wall.

6. A dispensing closure that includes:

a base, a lid and a pair of spaced hinge elements integrally connecting arcuate peripheral portions of said base and said lid for pivoting said lid between a closed position overlying said base and an open position remote from said base, said base including a deck wall, a skirt coupled to said deck wall and having internal means for securing the closure to a container, and a dispensing opening in said deck wall, said lid including a skirt that surrounds said deck wall in said closed position of said lid, said lid skirt including spaced interruptions at said hinge elements into which said hinge elements are received in said closed position of said lid, said deck wall having an upstanding arcuate part-annular wall positioned around said arcuate peripheral portion of said deck wall adjacent to said hinge elements and internally adjacent to an internal surface of said lid skirt at said hinge elements in said closed position of said lid to retard entry of moisture through said interruptions, said lid skirt being free of engagement with said upstanding wall between said open position and said closed positions of said lid.

7. The closure set forth in claim 6 wherein said arcuate wall portion on said deck wall has an arcuate dimension that is at least as great as the arcuate dimension of said interruptions in said lid skirt.

8. The closure set forth in claim 6 wherein said deck wall further includes a radially outwardly extending bead around a peripheral portion of said deck wall for abutting internal engagement with an internal surface of said lid skirt to retard entry of moisture in said closed position of said lid.

9. The closure set forth in claim 8 wherein said skirt on said lid has an internal bead that extends at least part-way around said skirt for snap-receipt over said bead on said deck wall in said closed position of said lid.

10. The closure set forth in claim 8 wherein said bead on said deck wall does not extend beneath said upstanding arcuate wall.

11. A closure and container package that includes:

a container having a finish with external means for securing a closure, and a dispensing closure comprising:

a base, and a lid integrally connected to said base by at least one hinge element for pivoting said lid between a closed position overlying said base and an open position remote from said base, said base including a deck wall, a skirt coupled to said deck wall and having internal means for securing the closure to said external means on said container, and a dispensing opening in said deck wall, said lid including a skirt that surrounds said deck wall in said closed position of said lid, said lid skirt including an interruption of said hinge element into which said hinge is received in said closed position of said lid, said deck wall having a radially outwardly projecting bead extending around a peripheral portion of said deck wall for abutting internal engagement with an internal surface of said lid skirt to retard entry of moisture in said closed position of said lid, and an upstanding part-annular arcuate wall positioned around a peripheral portion of said deck wall adjacent to said hinge element and internally adjacent to an internal surface of said lid skirt at said hinge element to retard entry of moisture through said interruption in said closed position of said lid.

12. The package set forth in claim 11 further comprising a disk liner between said closure base and said container finish.

13. The package set forth in claim 11 wherein said skirt on said lid has an internal bead that extends at least part-way around said skirt for snap-receipt.

14. The package set forth in claim 11 wherein said arcuate wall portion on said deck wall has an arcuate dimension that is at least as great as the arcuate dimension of said interruption in said skirt lid.

15. The package set forth in claim 11 wherein said bead on said deck wall does not extend beneath said upstanding arcuate wall.

16. A method of making a dispensing closure, which comprises the step of integrally injection molding a closure that includes:

a base, and a lid integrally connected to said base by at least one hinge element for pivoting said lid between a closed position overlying said base and an open position remote from said base, said base including a deck wall, a skirt coupled to said deck wall and having internal means for securing the closure to a container, and a dispensing opening in said deck wall, said lid including a skirt that surrounds said deck wall in said closed position of said lid, said lid skirt including an interruption of said hinge element into which said hinge is received in said closed position of said lid, said deck wall having a radially outwardly projecting bead extending around a peripheral portion of said deck wall for abutting internal engagement with an internal surface of said lid skirt to retard entry of moisture in said closed position of said lid, and an upstanding part-annular arcuate wall positioned around a peripheral portion of said deck wall adjacent to said hinge element and internally adjacent to an internal surface of said lid skirt at said hinge element to retard entry of moisture through said interruption in said closed position of said lid.

17. A dispensing closure that includes:

a base including a deck wall, a skirt coupled to said deck wall and having internal means for securing the closure to a container, and a dispensing opening in said deck wall, a lid having a peripheral skirt for surrounding said deck wall in a closed position of said lid, a pair of spaced hinge elements integrally connecting said lid to said deck for pivoting said lid between said closed position overlying said deck wall and an open position spaced from said base, said hinge elements extending between adjacent opposed arcuate peripheral portions of said base and said lid, said lid peripheral skirt having interruptions at said hinge elements onto which said hinge elements are received in said closed position of said lid, and an arcuate part-annular wall integrally upstanding from said deck wall at said arcuate peripheral portion of said base, said arcuate part-annular wall having a radially outer wall surface for abutting internal facing engagement with an opposing internal surface portion of said lid peripheral skirt at said interruptions to retard entry of moisture through said interruptions in said closed position of said lid.

18. The closure set forth in claim 17 wherein said arcuate part-annular wall has an angular length that is at least as great as the arcuate dimension of said interruptions in said lid skirt.

19. The closure set forth in claim 17 wherein said deck wall further includes a radially outwardly extending bead around a peripheral portion of said deck wall for abutting internal engagement with an internal surface of said lid skirt to retard entry of moisture in said closed position of said lid.

20. The closure set forth in claim 19 wherein said skirt on said lid has an internal bead that extends at least part-way around said skirt for snap-receipt over said bead on said deck wall in said closed position of said lid.

* * * * *